US006367176B1

(12) United States Patent
Zaugg et al.

(10) Patent No.: US 6,367,176 B1
(45) Date of Patent: Apr. 9, 2002

(54) ROTARY SNOW PLOW

(75) Inventors: Werner Zaugg, Eggiwil; Klaus Maurer, Aeschau, both of (CH)

(73) Assignee: Zaugg AG Eggiwil, Eggiwil (SE)

( * ) Notice: Subject to any disclaimer, the term of this patent is extended or adjusted under 35 U.S.C. 154(b) by 0 days.

(21) Appl. No.: 09/403,086

(22) PCT Filed: Apr. 16, 1998

(86) PCT No.: PCT/CH98/00143

§ 371 Date: Oct. 15, 1999

§ 102(e) Date: Oct. 15, 1999

(87) PCT Pub. No.: WO98/46832

PCT Pub. Date: Oct. 22, 1998

(30) Foreign Application Priority Data

Apr. 16, 1997 (CH) ..... 891/97
Sep. 23, 1997 (CH) ..... 2234/97

(51) Int. Cl.[7] ..... E01H 5/09
(52) U.S. Cl. ..... 37/240; 37/252
(58) Field of Search ..... 37/196, 197, 219, 37/221, 222, 223, 237, 238, 240, 242, 244, 249, 252, 253, 254

(56) References Cited

U.S. PATENT DOCUMENTS 3,464,128 A * 9/1969 Krickovich ..... 37/252
4,477,989 A * 10/1984 Vachon ..... 37/252
4,869,003 A * 9/1989 O'Loughlin ..... 37/255
5,209,003 A * 5/1993 Maxfield et al. ..... 37/252
5,479,730 A * 1/1996 Gogan ..... 37/231
5,940,995 A * 8/1999 Venhomaa ..... 37/240
6,085,445 A * 7/2000 Kanzler ..... 37/222
6,154,985 A * 12/2000 Champagne et al. ..... 37/222

FOREIGN PATENT DOCUMENTS

| | | |
|---|---|---|
| CH | 575515 | 5/1976 |
| FR | 1372434 | 12/1964 |
| FR | 2101924 | 3/1972 |

OTHER PUBLICATIONS

"Snow–Turbo Products Always In Front", Internationale Seilbahn Rundschau Revue Internationale Des Telepheriques, No. 3, Apr. 1997, p. 53.

* cited by examiner

*Primary Examiner*—Robert E. Pezzuto

(57) ABSTRACT

The rotary snow blower plow with a plow worm (18) which delivers the snow and a fan blower (19) which throws the delivered snow. The fan blower (19) is located on a line with the plow worm (18). The fan blower (19) and the plow worm (18) can be mounted on a common shaft (23) so that they rotate with the same angular speed. The rotary snow blower plow is characterized by high efficiency since the flow of snow need not be deflected by 90 degrees. It is especially suited for clearing of side walls and preparation of half pipe courses.

31 Claims, 7 Drawing Sheets

ROTARY SNOW PLOW

This application is the national phase under 35 U.S.C. §371 of PCT International Application No. PCT/CH98/00143 which has an International filing date of Apr. 16, 1998 which designated the United States of America.

TECHNICAL FIELD

The invention relates to a rotary snow blower plow with a plow worm which delivers the snow and a fan blower which throws the delivered snow. Furthermore the invention relates to a means with one such rotary snow blower plow.

1. Prior Art

Rotary snow blower plows are used to clear larger amounts of snow. On the one hand, they have a plow worm and on the other a fan blower. The plow worm breaks up the snow and delivers it to the fan blower, from which it is specifically thrown away via a chimney.

Rotary snow blower plows are used not only in the municipal domain (roads, parking lots, etc.), but also to prepare ski and snowboard courses. In any case the user is interested in the rotary snow blower plow having efficiency as high as possible. If there is already a utility vehicle, with its (often limited) power a working speed as high as possible is to be reached. If a new utility vehicle is procured, the lower power consumption of the rotary snow blower plow has the advantage that savings are possible in the power of the utility vehicle.

Snowboarding is very popular, mainly among the young. Demanding snowboarders however are not satisfied with riding on ordinary ski courses, but look for a challenge in specially prepared, channel-like snow vales which are called half pipes. One such snow vale in cross section has a flat middle part and two arc-shaped side walls. The radius of the side walls is in the range of 2.0–3.5 m.

For mechanical production and maintenance of these snow vales only one device is available on the market which can be attached to a conventional snow smoother. It consists essentially of a bogie truck and a curved plough which projects laterally from the roadway. The (often slightly compacted or hardened) snow is broken up with the indicated curved plow and conveyed to the outside with a scoop chain. The final shape of the side wall is produced with a correspondingly bent blade edge.

Specifically in the preparation of a half pipe course it must be considered that it must be cut in a slope with considerable steepness (typically 14° to 22°). In spite of high weight, in the known device there is the problem that it can drift from the correct position (i.e, from the direction of travel) in the case of heavy or hard snow.

2. Description of the Invention

The object of the invention is to devise a rotary snow blower plow of the initially mentioned type which is characterized by increased efficiency.

According to the invention, the fan blower is located on one line (i.e. on the same geometrical axis) with the plow worm.

In contrast to the convention rotary snow blower plows, in the invention the flow of snow need not be deflected by 90° to supply the fan blower. This benefits the efficiency and the power consumed. The invention is especially suitable for side wall clearing and preparation of half pipe courses.

Especially good efficiency can be achieved by the fact that the fan blower and the plow worm are attached on a common shaft. The fan blower and plow worm are therefore rigidly coupled to one another to rotate. The drive can be structurally made relatively simple as a result.

Preferably the device is equipped with a hydraulic drive. This is supplied by the utility vehicle. Instead of a hydraulic drive a mechanical one can also be used.

Preferably the plow worm and fan blower run with different speed. For this purpose there can be gearing which produces a certain stepping-down. The lower rotation speed of the plow worm is advantageous for optimization of efficiency. At the same time, it can be desirable specifically in the municipal domain (for example in the clearing of side walls) for reasons of safety engineering if the plow worm runs comparatively slowly (the peripheral speed of the fan blower should not fall below a stipulated minimum value). The step-down ratio is at least 1:2, preferably roughly 1:4.

The rotary snow blower plow as claimed in the invention is preferably used as a component of a device for preparing half pipe courses. One such device has not only an individual plow worm, but a plurality of plow elements which are located on an arc (according to the side wall to be prepared). The plow elements themselves have barrel-shaped envelope curves in order to be able to plow a continuous arc.

The device comprises a blade edge and a curved plow which has been placed in advance of this edge (in the direction of travel). On the bottom of the curved plow is the rotary snow blower plow. The curved plow itself and its drive are made such that the snow to be removed is driven downward or inward to the snow blower.

Viewed in terms of the process, the snow is first broken down by the curved plow and delivered downward and inward and then from there it is conveyed away in the snow blower in a direction which is freely selectable according to requirements of individual case.

In contrast to the known process, in the invention the snow is moved, not directly to the outside, but first to the inside (where it actually cannot remain). From this location the snow however at this point is thrown, carefully directed. The direction can be rather freely chosen by the user. In this way it becomes possible to specifically fill holes when maintaining the snow vale or to raise the side wall.

Another advantage of the invention consists in that the side wall can be made optionally steep. In particular, it is not a problem to prepare a wall with a vertical section on the upper end since the snow is not scooped directly over this section, but is always brought first downward to the snow blower.

According to one preferred embodiment the means as claimed in the invention is rigidly guided on the front side of a snow smoother. The driver thus has more precise control over the direction of travel. He notices immediately on the vehicle when the curved plow is trying to swing and can consequently countersteer.

If to the left and right of the vehicle one curved plow at a time is mounted, it is always possible to work from bottom to top (i.e. uphill). It is consequently unnecessary to turn the vehicle on the upper end of the half pipe (which is often a problem). Otherwise in this way the two side walls of the half pipe course can be simultaneously cut from the new snow. This process leads to largely symmetrical loading. The unwanted torques which try to turn the entire means out of the direction of travel are minimal.

The drive is for example a hydraulic motor which is connected in series to another hydraulic motor to drive the snow blower. The curved plow is formed for example by multiple plow worms.

In contrast to the prior art, the assembly as claimed in the invention does not require a scoop chain. In this respect it is a simple construction.

Advantageously the blade edge is located in a surface which is sloped to the vertical plane. The blade edge should form a curve which moves away farther and farther to the front as the height increases (i.e. from the vertical plane in the direction of travel). In steep terrain (when climbing) it is thus ensured that the snow masses slide easily to the inside toward the snow blower. Preferably the blade edge runs in a plane which is tilted by a maximum 30° (especially by 10 to 25°) to the vertical.

The curved plow can be swivelled around an axis such that it can be placed to the inside above the snow blower for transport purposes. The swivel axis runs essentially in a horizontal plane (i.e. the plane parallel to the roadway). It can be slightly increased relative to the direction of travel in order to bring the center of gravity of the curved plow in the folded-in state nearer the vehicle.

The curved plow as claimed in the invention is preferably made as a separable assembly to an existing rotary snow blower plow. I.e. it can be mounted laterally to the side as required.

In contrast to the prior art, the curved plow as claimed in the invention does not require especially great inherent weight to keep to the track. It is rigidly connected to the motor vehicle and consequently has the corresponding guidance. Therefore the effort is made to build the separable assembly to be as light as possible. It has been shown that it is possible to make do with roughly one eighth of the inherent weight of the known device.

Other advantageous embodiments and feature combinations of the invention follow from the following detailed description and the totality of the patent claims.

BRIEF DESCRIPTION OF THE DRAWINGS

The drawings used to explain the embodiment show.

Basically in the figures the same parts are provided with the same reference numbers.

IMPLEMENTATION OF THE INVENTION

Figure 5B:
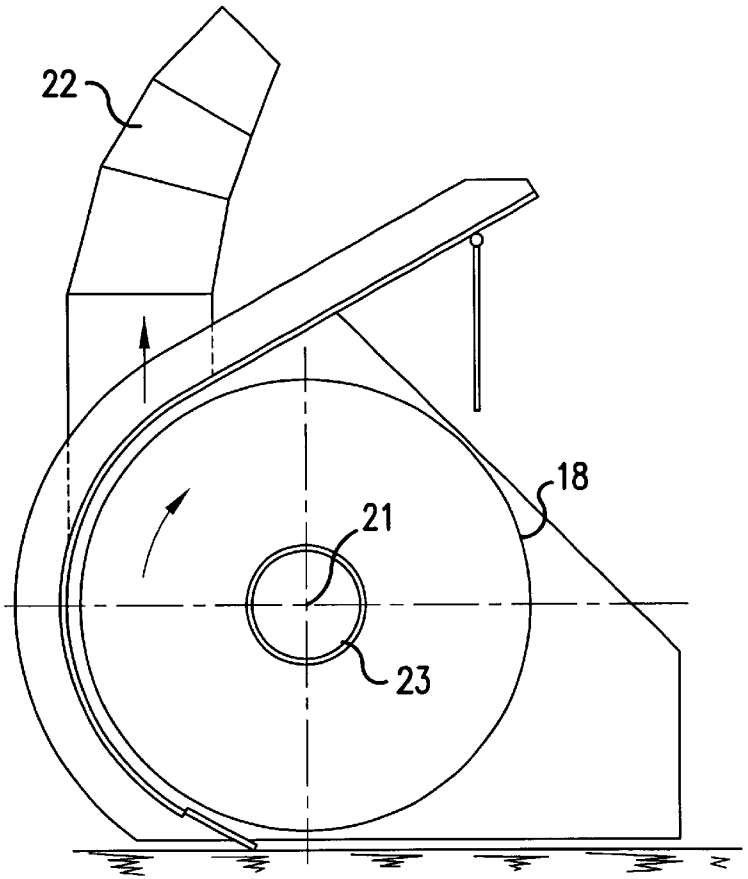
FIGS. 5*a, b* show a rotary snow blower plow as claimed in the invention viewed from the front and from the side.
Figure 5A:
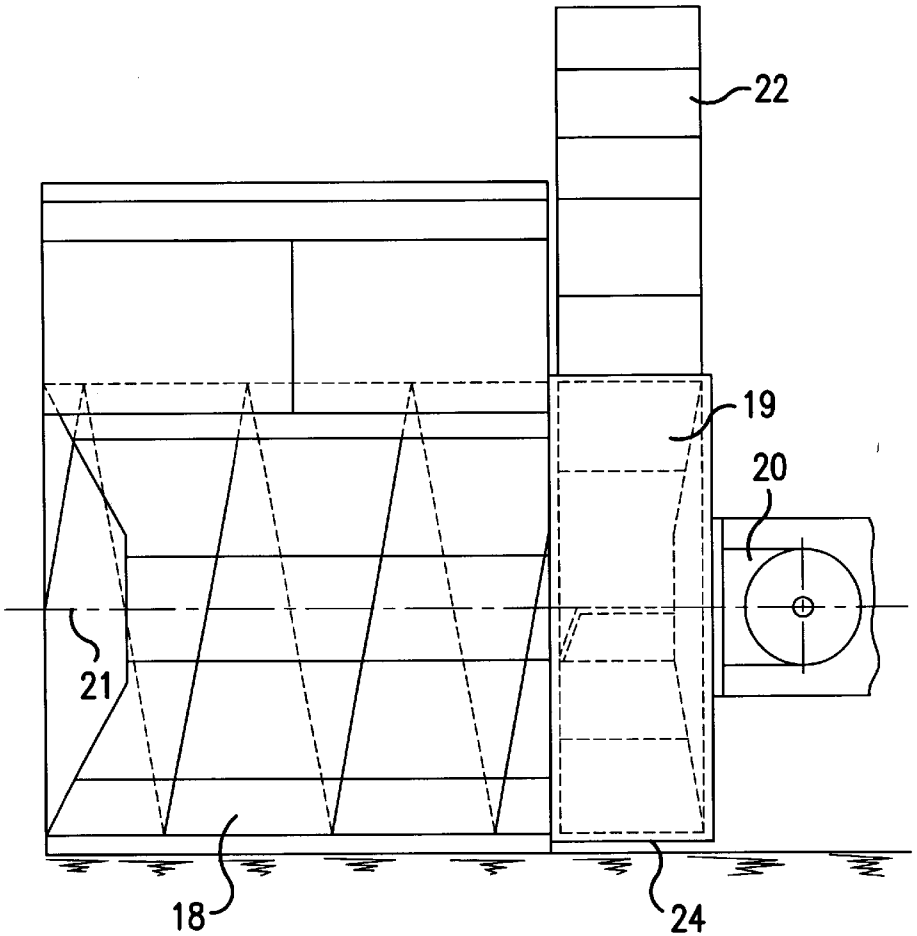

FIGS. 5*a, b* show a rotary snow blower plow as claimed in the invention with a plow worm 18 (also called a plow reel) and a fan blower 19 (discharge fan) which have a common axis of rotation 21. I.e. the fan blower 19 is located on a line behind the plow worm 18 ("inline"). The broken snow which has been removed by the plow worm 18 is thus pushed without deflection directly into the fan blower 19. There it is picked up and ejected through the chimney 22 at high speed.

According to one especially preferred embodiment the plow worm 18 and the fan blower 19 sit on the same shaft 23 so that they turn with the same angular speed. The shaft 23 is supported only on one side, and the rotary snow blower plow is open on the outer end of the plow worm 18. On the back (i.e. opposite the plow worm 18) side of the fan blower 19 there is inlet gearing 20. It can be for example a simple bevel gear pair which is driven via an articulated shaft of a utility vehicle which bears the rotary snow blower plow.

In the described embodiment the fan blower 19 is housed in a closed (in the radial direction) housing 24. I.e. in the axial area of the fan blower 19 no snow can be removed. Clearing takes place only in the area of the plow worm 18. Thus the described rotary snow blower plow is intended for applications in which only one side of a roadway or a course need be cleared or prepared. One example is the side wall clearing in the municipal domain and the preparation and maintenance of half pipe courses.

The peripheral speed of the fan blower 19 is determined by the desired throw. Typically it is for example 20–35 m/s. For the plow worm 18 which sits on the same shaft in the described embodiment this angular speed is rather high. To keep the axial conveyor speed within desired limits, therefore preferably the pitch of the worm is reduced compared to conventional rotary snow blower plows.

Figure 6:
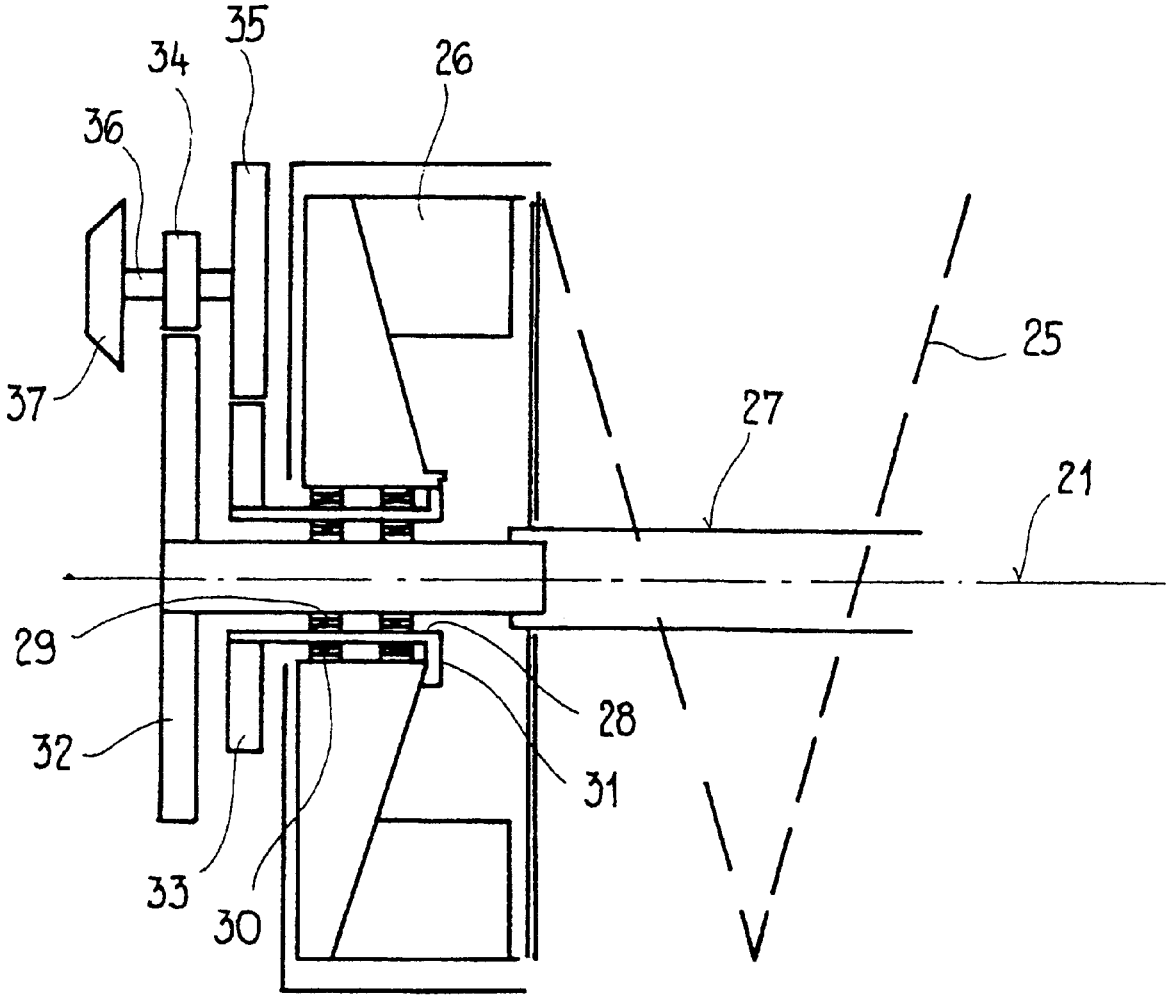
FIG. 6 shows a schematic of gearing for the stepped-down drive of the plough worm.

For safety considerations it can be desirable in certain applications that the plow worm runs stepped-down compared to the fan blower. To do this for example the gearing structure shown schematically in FIG. 6 can be provided. As before, the plow worm 25 and the fan blower 26 are located in succession on a common axis of rotation 21, but have independent drive shafts 27, 28. As is apparent from FIG. 6, the drive shaft 28 of the fan blower 26 is for example a hollow shaft. In it the drive shaft 27 of the plow worm is coaxially supported. (A first bearing 29 is provided between the drive shafts 27, 28 and a second bearing 30 is between the drive shaft 28 and fan blower 28 for support of the fan blower 26). The drive shaft 28 and the fan blower 26 are rigidly connected to one another by connecting pieces 31.

The drive shafts 27, 28 are coupled for example by conventional step-down gearing in a ratio of 1:4. I.e. the ratios of the size of the gears 32, 34 on the one hand and the gears 33, 35 on the other are selected such that the plow worm 25 (the gear 32 sits on its drive shaft 27) has an angular speed stepped down by a factor of 4 compared to the fan blower 16. The drive shaft 27 on which gear 32 sits can be connected via a bevel gear pair 37 by an articulated shaft to the primary power take-off shaft of the utility vehicle. The gears 34, 35 responsible for the stepping down sit on the axle 36.

The rotary snow blower plow can be also be driven hydraulically instead of mechanically.

In the following one preferred embodiment is explained in detail with reference to FIGS. 1 to 4.

A rotary snow blower plow 1 is securely mounted on a snow smoother (not shown) on the front. It prepares the flat roadway 3 which forms the bottom of the half pipe. On the side which is the left in this example a curved plow 2 is mounted. It prepares the side wall 4 of the half pipe, said wall being curved in an arc-shape in cross section. The radius of curvature is for example 3 m.

As claimed in the invention the curved plow 2 works the snow from the side inwardly, i.e. downward to the rotary snow blower plow 1. The latter is equipped with two fans 5.1, 5.2 which throw the snow through the chimneys 6.1, 6.2. On the top ends the chimneys 6.1, 6.2 have adjustable, flexible guide pipes 7.1, 7.2 which can be turned and bent in the desired direction.

The rotary snow blower plow 1 is equipped in the conventional manner with a plow worm (not shown in the figures).

The curved plow 2 in this example has four synchronously running plow worms 8.1 to 8.4. The enveloping surface of each plow worm 8.1 to 8.4 is arched to be barrel-shaped. Furthermore the axes of rotation of the plow worms 8.1 to 8.4 do not lie on a straight line, but include a certain angle. The barrel-shaped arch of the curved worms 8.1 to 8.4 and these angles are selected such that in the view according to FIG. 1 a continuous circular arc is formed.

It should be watched that the enveloping surfaces of the adjacent plow worms 8.1/8.2 and 8.2/8.3 partially intersect one another. In this way the gap between the plow worms can be minimized on the bottom side of the curved plow (i.e. for blade 9).

Figure 4:
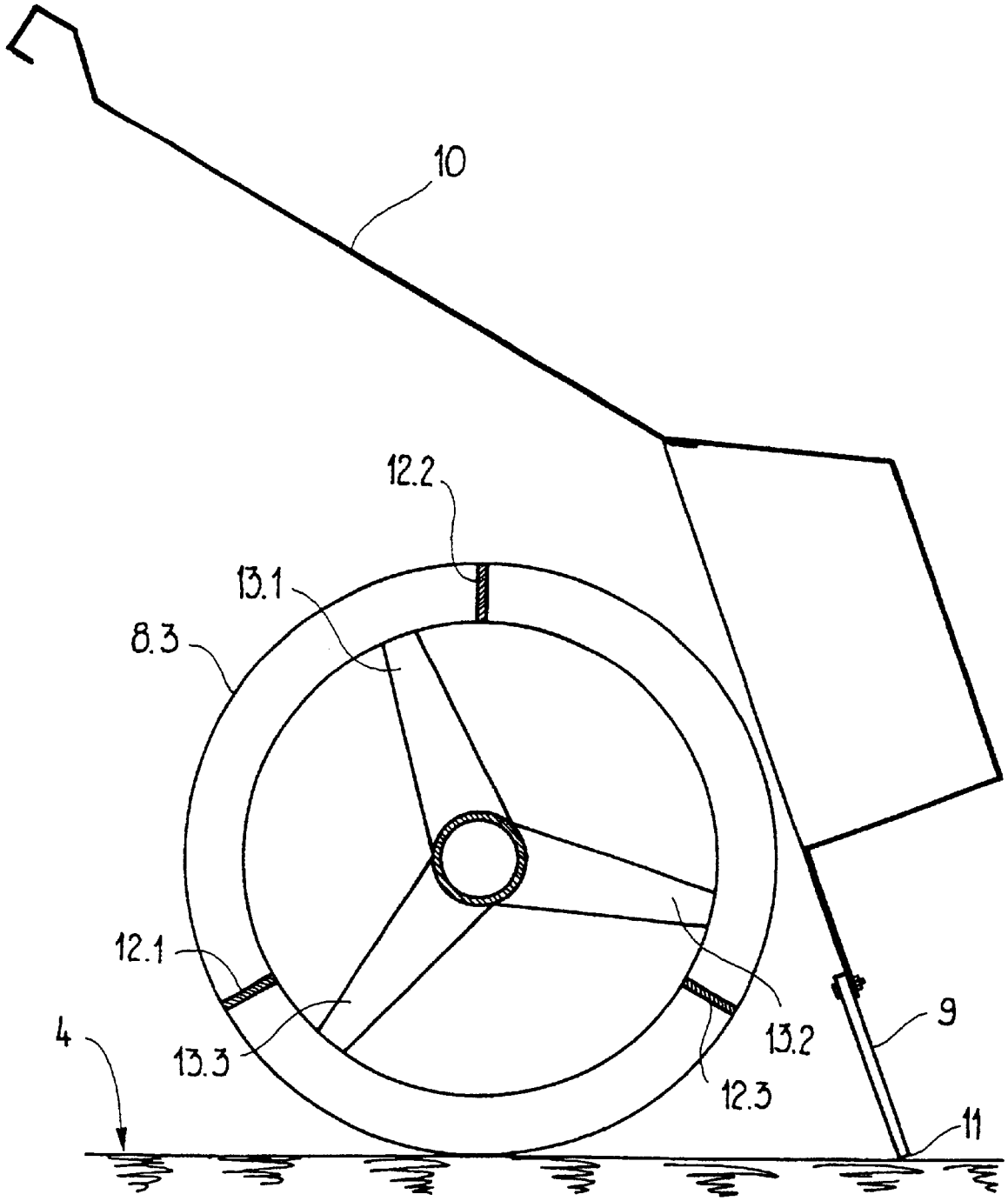
FIG. 4 shows a schematic of the cross section ¦.¦ from FIG. 1.

As is especially apparent from FIG. 4, the plow worms 8.1 to 8.4 are located under a cover 10 (for example, angular in cross section). A blade 9 is attached to the bottom of this cover 10. The blade is located (with reference to the direction of travel) behind the plow worms 8.1 to 8.4 and with its blade edge 11 (which is preferably finely corrugated or toothed) forms the side wall 4. The corrugations or teeth of the blade edge 11 press a rib/groove pattern into the snow; this leads to a high quality half pipe path.

FIG. 4 shows the plow worm 8.3 of the curved plow 2 in cross section. According to one especially preferred embodiment it is an open triple-thread worm. I.e. there are three spiral plow blades 12.1, 12.2, 12.3 which are supported by several spokes 13.1, 13.2, 13.3. The plow blades 12.1, 12.2, 12.3 can be provided with teeth.

The plow worms 8.1 to 8.4 are mechanically coupled to one another (by universal joints). The innermost plow worm 8.4 is driven by a hydraulic motor (which is not shown in the Figures). This hydraulic motor is connected for example in series to the hydraulic drive of the rotary snow blower plow 1 and is actuated by the snow smoother.

The direction in which the plow worms 8.1 to 8.4 rotate and the direction in which the hydraulic motor turns are selected such that the snow tends to be delivered to the inside to the rotary snow blower plow 1.

It should be noticed that the outermost plow worm 8.1 under certain circumstances can be omitted. I.e. the arc worked by the plow worms need not be covered by that of the blade edge 11. There can consequently be a segment 14 on the outside of the curved plow 2 which works only with one blade. Since the snow in the curved plow 2 as claimed in the invention is always delivered downward (and not upward, as in the prior art), the snow scraped off in segment 14 can fall downward into the plow worm 8.2 anyway, which then brings it to the rotary snow blower plow.

Figure 3:
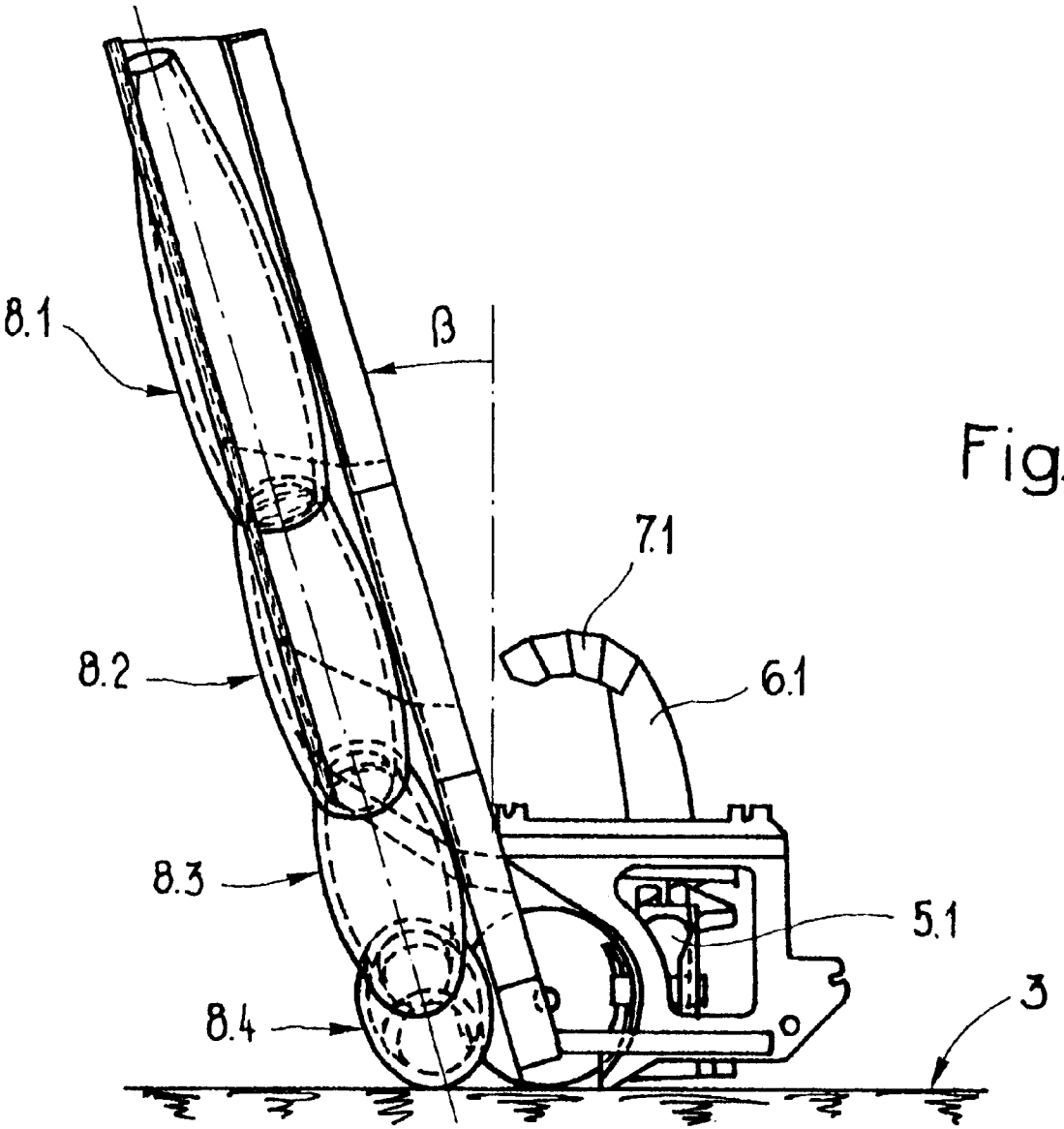
FIG. 3 shows one view of the same embodiment from the side.

As is apparent from FIG. 3, the curved plow 2 is advantageously tilted forward. I.e. there is an angle <90° between the plane of the roadway 3 and the plane in which the blade edge 11 runs. The angle β drawn in FIG. 3 is for example 20°. This has the advantage that when climbing in steep slopes the curved plow 2 is never tilted to the rear against the vehicle. The snow always flows easily down.

Figure 1:
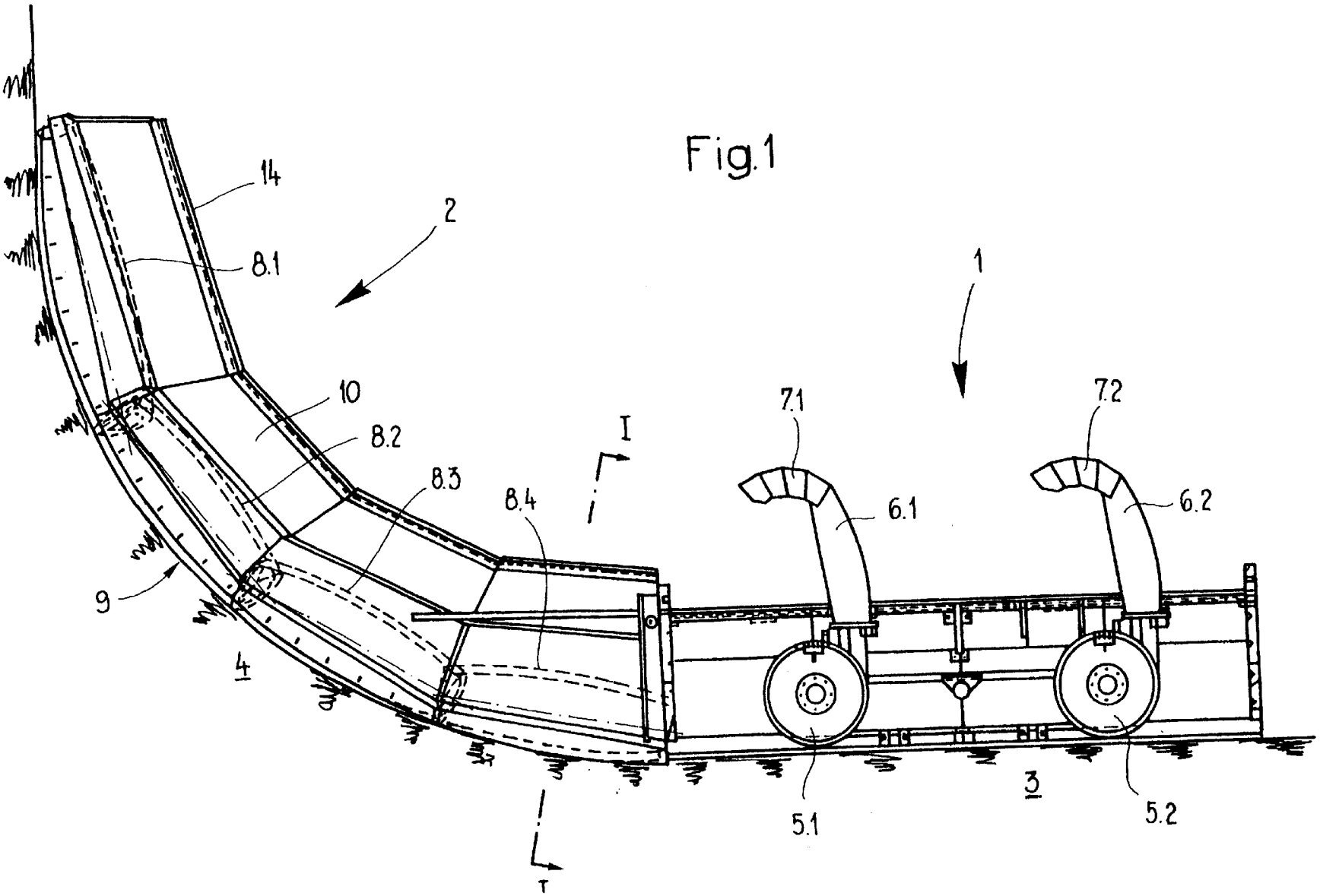
FIG. 1 shows one preferred embodiment viewed from the rear.
Figure 2:
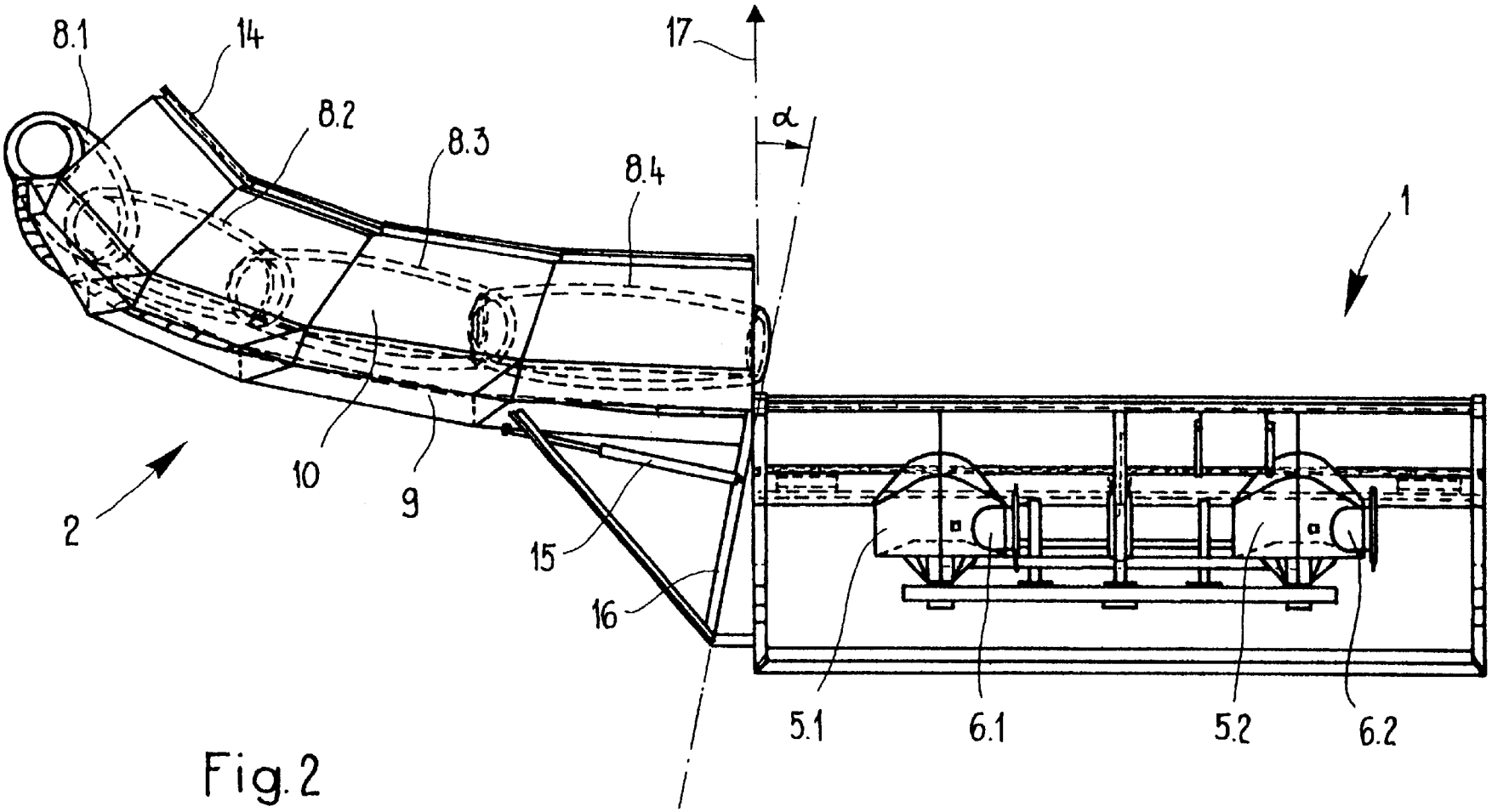
FIG. 2 shows one view of the same embodiment from overhead.

In the overhead view as shown in FIG. 2 the tilt of the curved plow 2 just described can be detected by the blade edge 11 being withdrawn from the vertical plane the more so that it runs away from the inside (i.e. from the rotary snow blower plow 1).

Furthermore, it is shown in FIG. 2 that the plow worms 8.1 to 8.4 viewed in the direction of travel are located in front of the rotary snow blower plow 1. I.e. the snow is input from the front into the rotary snow blower plow 1 which is laterally closed.

According to one especially preferred embodiment of the invention, the curved plow can be folded around a swivel axis 16 using a hydraulic cylinder 15 (compare FIG. 2). In the folded state the curved plow 2 is located directly above the rotary snow blower plow 1. Because the direction of the swivel axis 16 is turned to the direction of travel 17 by a small angle $\alpha>0$, the center of gravity of the folded curved plow 2 is nearer the vehicle. The angle a is matched to the tilt β. It is roughly 10° to 20°.

Advantageously the curved plow 2 is made in the manner of an independent assembly which can be attached with quick acting closures laterally to a conventional rotary snow blower plow.

Figure 7:
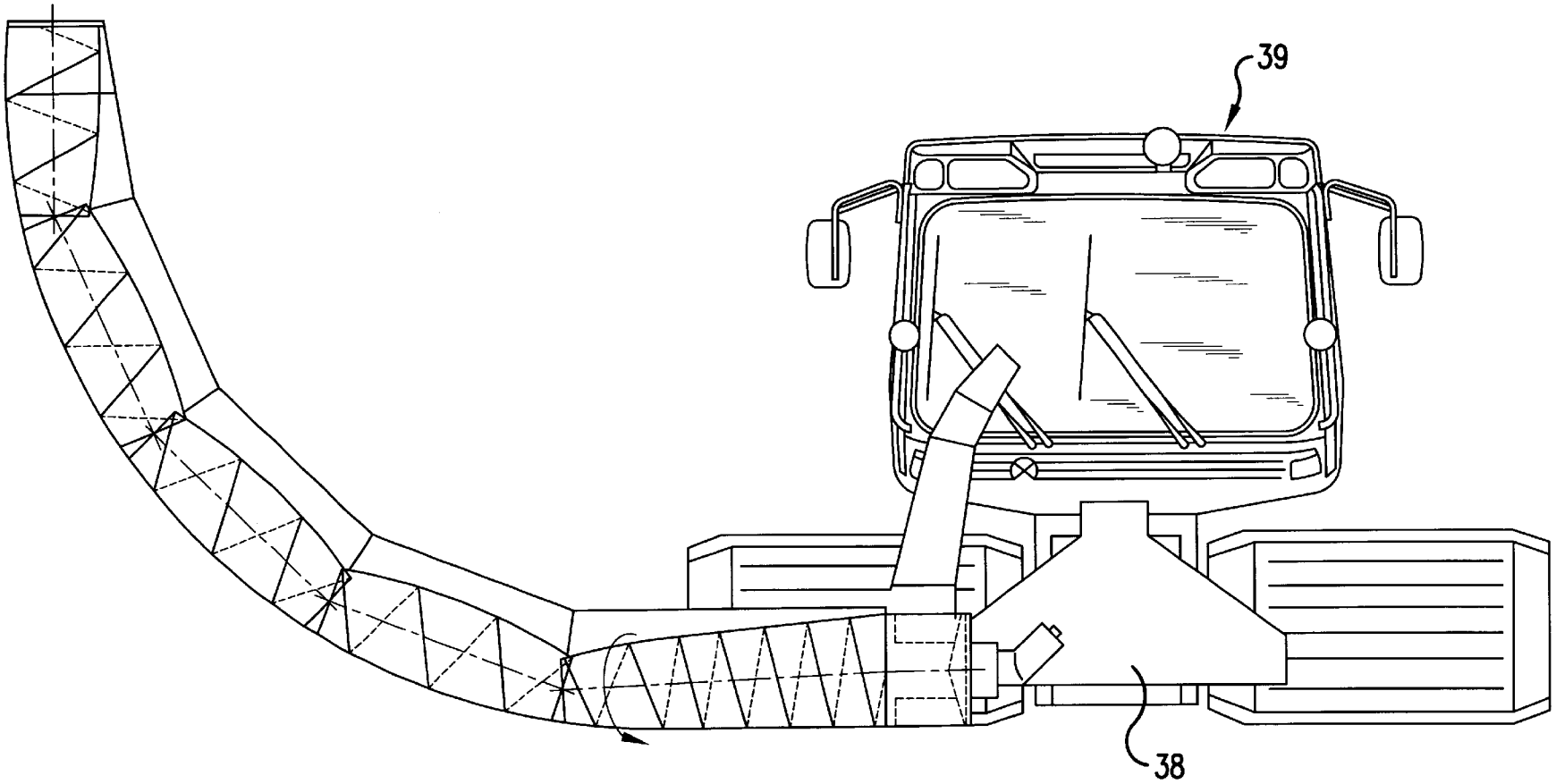
FIG. 7 shows a rotary snow blower plow for preparing a half pipe course.

The embodiment shown in FIG. 7 represents a combination of the rotary snow blower plow as claimed in the invention with the curved plow which has just been described. It is a coherent functional unit which is mounted on the front-side frame 38 of a tracked vehicle 39. It has a lower weight than the arrangement with the conventional rotary snow blower plow shown in FIG. 1.

It is clear that the invention is not limited to the details of the described embodiment. Thus for example the number and execution of the plow worms can be matched to the requirements, as already mentioned the plow worms not necessarily running as far as the outermost edge of the curved plow (i.e. to the outer end of the blade edge). Otherwise, instead of plow worms other assemblies which are suited for breaking down hardened snow covers can be used.

The rotary snow blower plow given in the preferred embodiment is an assembly which first breaks down the snow and then throws it away, carefully directed. It generally comprises a plow worm and a fan with discharge chimney. For the execution of the invention one fan with a discharge chimney is in principle enough. The plow worm is optional. It allows clearing or working of the roadway.

It is a great advantage, but not necessarily essential, that the device as claimed in the invention is attached forward to the vehicle. If it is only matter of maintenance of an existing half pipe it is quite conceivable that the curved plow could be mounted on the back of the snow smoother.

The tilt of the curved plow can also be used to make the curvature of the side wall elliptical instead of circularly arc-shaped. Nor is it precluded that the tilt can be adjusted at will by the user (within certain limits). Otherwise it is easy to change the run of the curvature of the side wall by replacing the blade.

In summary it can be stated that an efficient, structurally simple assembly has been devised for clearing snow or preparing courses by the invention. It is especially suited for combination with a curved plow for producing half pipe courses.

What is claimed is:

1. Apparatus for preparing and maintaining a side wall of a snow vale, said wall rising in an arc-shape in cross section, said apparatus comprising:

a blade edge;

a curved plow in advance of said blade edge, said curved plow comprising means for driving snow to be removed in a generally downward direction; and a snow blower for receiving snow to be removed from said means for driving, said snow blower comprising means for throwing snow in a selected direction.

2. Apparatus as claimed in claim 1, wherein said curved plow and said snow blower are attached on the front of a vehicle, said curved plow projecting laterally with reference to the path of the vehicle.

3. Apparatus as claimed in claim 1, wherein said blade edge extends upwardly and forwardly from a vertical plane.

4. Apparatus as claimed in claim 3, wherein said blade edge lies in a plane which is tilted by an angle of up to 30° against the vertical.

5. Apparatus as claimed in claim 1, further comprising a hinge for folding said curved plow to a position above said snow blower.

6. Apparatus as claimed in claim 5, wherein said hinge pivots about an axis that is set at an angle of up to 30° relative to the direction of travel.

7. Apparatus as claimed in claim 1, further comprising releasable closures for selectively attaching or detaching said curved plow to said snow blower.

8. Apparatus as claimed in claim 1, wherein said snow blower is a rotary snow blower and comprises a plow worm which delivers the snow and a fan blower which throws the delivered snow, said fan blower being located on a line with said plow worm.

9. Apparatus as claimed in claim 8, wherein said fan blower and said plow worm are aligned on a common shaft and rotate with the same angular speed.

10. Apparatus as claimed in claim 8, comprising a hydraulic drive for driving said fan blower and said plow worm.

11. Apparatus as claimed in claim 8, comprising step-down gearing for driving said plow worm at a lower speed than said fan blower.

12. Apparatus as claimed in claim 11, wherein said step-down gearing drives said worm and said fan at a speed ratio of at least 1:2.

13. Apparatus as claimed in claim 1, said curved plow comprising at least two plow worms, wherein the plow worms are coupled to each other.

14. Apparatus as claimed in claim 1, said curved plow comprising at least two plow worms, wherein the enveloping surfaces of adjacent plow worms partially intersect one another.

15. Apparatus as claimed in claim 4, wherein said angle is between 10° and 25°.

16. Apparatus as claimed in claim 11, wherein said step-down gearing drives said worm and said fan at a speed ratio of at least 1:4.

17. Apparatus as claimed in claim 1, said curved plow comprising at least two plow worms, wherein the axes of rotation of said plow worms are set at an angle to each other for defining the shape of the arc of the side wall.

18. Apparatus as claimed in claim 1, said curved plow comprising at least one plow worm.

19. Apparatus as claimed in claim 18, wherein said at least one plow worm comprises spiral plow blades.

20. Apparatus as claimed in claim 11, wherein said at least one plow worm has a barrel-shaped enveloping surface.

21. Process for preparing and maintaining a side wall of a snow vale, said wall rising in an arc-shape in cross section, comprising:

removing snow with a curved plow and conveying the snow in a downward direction along the curved plow to a snow blower; and directing the snow to a desired location with said snow blower.

22. Process as claimed in claim 21, wherein the curved plow and snow blower are guided on the front of a vehicle.

23. Apparatus for preparing and maintaining a side wall of a snow vale, said wall rising in an arc-shape in cross section, said apparatus comprising:

a curved plow comprising means for driving snow to be removed in a generally downward direction; and a snow blower for receiving snow to be removed from said means for driving, said snow blower comprising means for throwing snow in a selected direction.

24. Apparatus as claimed in claim 23, wherein said curved plow extends upwardly and forwardly from a vertical plane.

25. Apparatus as claimed in claim 23, further comprising a hinge for folding said curved plow to a position above said snow blower.

26. Apparatus as claimed in claim 23, said curved plow comprising at least one plow worm.

27. Apparatus as claimed in claim 26, wherein said at least one plow worm has a barrel-shaped enveloping surface.

28. Apparatus as claimed in claim 23, said curved plow comprising at least two plow worms, wherein the axes of rotation of said plow worms are set at an angle to each other for defining the shape of the arc of the side wall.

29. Apparatus as claimed in claim 23, said curved plow comprising at least two plow worms, wherein the enveloping surfaces of adjacent plow worms partially intersect one another.

30. Apparatus as claimed in claim 26, wherein said at least one plow worm comprises spiral plow blades.

31. Apparatus as claimed in claim 23, said curved plow comprising at least two plow worms, wherein the plow worms are coupled to each other.

* * * * *